US009765603B2

(12) United States Patent
Qi et al.

(10) Patent No.: US 9,765,603 B2
(45) Date of Patent: Sep. 19, 2017

(54) GAS LIFT VALVE ASSEMBLIES AND METHODS OF ASSEMBLING SAME

(71) Applicant: General Electric Company, Schenectady, NY (US)

(72) Inventors: Xuele Qi, Niskayuna, NY (US); Norman Arnold Turnquist, Carlisle, NY (US); Roderick Mark Lusted, Niskayuna, NY (US); Omprakash Samudrala, Clifton Park, NY (US); Shourya Prakash Otta, Guilderland, NY (US); Ricardo Lopez, Houston, TX (US); Jifeng Wang, Niskayuna, NY (US); Vic Arthur Randazzo, Erath, LA (US)

(73) Assignee: General Electric Company, Niskayuna, NY (US)

( * ) Notice: Subject to any disclaimer, the term of this patent is extended or adjusted under 35 U.S.C. 154(b) by 238 days.

(21) Appl. No.: 14/555,193

(22) Filed: Nov. 26, 2014

(65) Prior Publication Data

US 2016/0145981 A1 May 26, 2016

(51) Int. Cl.

| | |
|---|---|
| ***E21B 43/12*** | (2006.01) |
| ***E21B 34/10*** | (2006.01) |
| ***E21B 34/16*** | (2006.01) |

(52) U.S. Cl.

CPC ..... *E21B 43/123* (2013.01); *E21B 34/10* (2013.01); *E21B 34/16* (2013.01)

(58) Field of Classification Search

CPC ..... E21B 40/123; E21B 34/10; E21B 34/16; E21B 43/123; E21B 34/00; E21B 34/06; E21B 34/14

See application file for complete search history.

(56) References Cited

U.S. PATENT DOCUMENTS

| | | | |
|---|---|---|---|
| 2,223,337 | A | 11/1940 | Hatfield |
| 2,256,704 | A | 9/1941 | Crickmer et al. |
| 2,634,689 | A | 4/1953 | Walton |
| 2,892,415 | A | 6/1959 | McGowen |
| 2,931,385 | A | 4/1960 | Carlisle et al. |

(Continued)

FOREIGN PATENT DOCUMENTS

| | | | |
|---|---|---|---|
| GB | 2510070 | A | 7/2014 |
| WO | 2014039740 | A1 | 3/2014 |

OTHER PUBLICATIONS

PCT Search Report and Written Opinion issued in connection with corresponding Application No. PCT/US15/061815 on Feb. 25, 2016.

(Continued)

*Primary Examiner* — Nicole Coy
*Assistant Examiner* — Tara Schimpf
(74) *Attorney, Agent, or Firm* — Pabitra K. Chakrabarti

(57) ABSTRACT

A gas lift valve assembly includes a housing and a check valve. The housing defines an inlet port and an outlet port, and includes an inner casing having a radial outer surface and a radial inner surface at least partially defining a main flow passage. The check valve includes a sealing mechanism disposed around the radial outer surface of the inner casing, and a valve member including an outwardly extending sealing segment. The valve member is moveable between an open position and a closed position in which the sealing segment sealingly engages the sealing mechanism.

19 Claims, 7 Drawing Sheets

(56) References Cited

U.S. PATENT DOCUMENTS

| | | | | |
|---|---|---|---|---|
| 3,143,128 | A | 8/1964 | Bicking, Jr. | |
| 3,278,192 | A | 10/1966 | Tamplen | |
| 3,302,721 | A | 2/1967 | Yetman | |
| 3,381,756 | A | 5/1968 | Reagan | |
| 3,398,760 | A | 8/1968 | Fox et al. | |
| 3,410,346 | A | 11/1968 | Garrett et al. | |
| 3,776,250 | A | 12/1973 | Knox | |
| 3,844,352 | A | 10/1974 | Garrett | |
| 4,151,875 | A | 5/1979 | Sullaway | |
| 4,200,158 | A | 4/1980 | Perkins | |
| 4,635,725 | A | 1/1987 | Burroughs | |
| 4,682,656 | A | 7/1987 | Waters | |
| 4,930,539 | A | 6/1990 | van Rooy | |
| 5,022,427 | A | 6/1991 | Churchman et al. | |
| 5,069,280 | A | 12/1991 | McKee et al. | |
| 5,707,214 | A | 1/1998 | Schmidt | |
| 6,460,620 | B1 | 10/2002 | LaFleur | |
| 6,715,550 | B2 | 4/2004 | Vinegar et al. | |
| 6,758,276 | B2 | 7/2004 | Reynolds | |
| 7,077,208 | B2 | 7/2006 | Harrington et al. | |
| 7,228,909 | B2 | 6/2007 | Schmidt et al. | |
| 7,360,602 | B2 | 4/2008 | Kritzler et al. | |
| 8,181,705 | B2 | 5/2012 | Tveiten et al. | |
| 8,225,874 | B2 | 7/2012 | Messick et al. | |
| 8,561,703 | B2 | 10/2013 | Mahmoud et al. | |
| 8,763,706 | B2 | 7/2014 | Lembcke | |
| 2004/0221997 | A1 | 11/2004 | Giroux et al. | |
| 2009/0044947 | A1* | 2/2009 | White | E21B 43/123 166/321 |
| 2010/0319924 | A1* | 12/2010 | Mahmoud | E21B 43/123 166/325 |
| 2011/0203805 | A1 | 8/2011 | Kritzler et al. | |
| 2011/0315401 | A1 | 12/2011 | White et al. | |
| 2013/0075108 | A1 | 3/2013 | Frisby et al. | |
| 2013/0206239 | A1 | 8/2013 | Stokka et al. | |
| 2013/0255947 | A1 | 10/2013 | Frisby et al. | |
| 2013/0255958 | A1 | 10/2013 | Frisby et al. | |
| 2013/0255961 | A1 | 10/2013 | Frisby et al. | |
| 2013/0291961 | A1 | 11/2013 | Tveiten et al. | |
| 2014/0041863 | A1 | 2/2014 | Dowling et al. | |
| 2014/0138099 | A1* | 5/2014 | Scarsdale | E21B 43/123 166/373 |
| 2015/0144826 | A1* | 5/2015 | Bayyouk | F16K 25/005 251/359 |

OTHER PUBLICATIONS

PCT Search Report and Written Opinion issued in connection with PCT Application No. PCT/US2015/061737 on May 6, 2016.

* cited by examiner

GAS LIFT VALVE ASSEMBLIES AND METHODS OF ASSEMBLING SAME

BACKGROUND

The field of the disclosure relates generally to artificial gas lift systems, and more particularly, to gas lift valve assemblies and methods of assembling gas lift valve assemblies.

Artificial gas lift systems are often used to facilitate the extraction of fluids, such as hydrocarbons, from subterranean fluid-containing formations having insufficient pressure to naturally force fluids out of the formation through a wellbore. Such gas lift systems generally include a well casing lining the wellbore, and a production tubing extending into the fluid-containing formation. Pressurized fluid is injected into the production tubing through an annulus defined between the production tubing and the well casing. The pressurized fluid enters the production tubing through one or more gas lift valve assemblies disposed at various depths along the production tubing. The pressurized fluid displaces denser production fluids within the production tubing, thereby decreasing the hydrostatic pressure within the production tubing and enhancing the rate at which fluids can be extracted from the subterranean formation.

Industry standards for acceptable leak rates through gas lift valve assemblies used in artificial gas lift systems have become increasingly stringent in recent years, particularly for off-shore and deep sea gas lift systems. Meeting such industry standards using known gas lift valve assemblies has presented significant challenges due in part to the wide range of pressures and temperatures experienced within the production tubing during operation.

Some known gas lift valve assemblies utilize a check valve to inhibit fluid within the production tubing from leaking to the annulus. The sealing components of such gas lift valve assemblies, however, are typically located directly in the path of fluid flow. As a result, the sealing surfaces of the sealing components are exposed to high velocity fluid flow, which may contain solid, abrasive particles, causing rapid wear of the sealing components.

Accessing gas lift valve assemblies within the gas lift system for maintenance or repairs is generally difficult, costly, and requires a significant amount of down time for the gas lift system. Such down time can result in a significant amount of production losses. In some instances, for example, accessing a gas lift valve assembly for maintenance or repairs can require one to two days of down time, and can have a total cost in excess of $1 million. Accordingly, a continuing need exists for a gas lift valve assembly having an acceptable leak rate and an improved service life.

BRIEF DESCRIPTION

In one aspect, a gas lift valve assembly is provided. The gas lift valve assembly includes a housing and a check valve. The housing defines an inlet port and an outlet port, and includes an inner casing having a radial outer surface and a radial inner surface at least partially defining a main flow passage. The check valve includes a sealing mechanism disposed around the radial outer surface of the inner casing, and a valve member including an outwardly extending sealing segment. The valve member is moveable between an open position and a closed position in which the sealing segment sealingly engages the sealing mechanism.

In another aspect, a method of assembling a gas lift valve assembly is provided. The method includes providing a housing defining an inlet port and an outlet port, the housing including an inner casing having a radial outer surface and a radial inner surface at least partially defining a main flow passage providing fluid communication between the inlet port and the outlet port, providing a sealing mechanism around the radial outer surface of the inner casing, and coupling a valve member including an outwardly extending sealing segment to the housing such that the valve member is moveable between an open position and a closed position in which the sealing segment sealingly engages the sealing mechanism.

In yet another aspect, a gas lift system is provided. The gas lift system includes a production tubing defining a central passageway, a well casing defining an annulus between the production tubing and the outer casing, and a gas lift valve assembly coupled in fluid communication between the annulus and the central passageway. The gas lift valve assembly includes a housing and a check valve. The housing defines an inlet port and an outlet port, and includes an inner casing having a radial outer surface and a radial inner surface at least partially defining a main flow passage. The check valve includes a sealing mechanism disposed around the radial outer surface of the inner casing, and a valve member including an outwardly extending sealing segment. The valve member is moveable between an open position and a closed position in which the sealing segment sealingly engages the sealing mechanism.

DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

The systems, methods, and apparatus described herein facilitate reducing the leakage rate and improving the service life of gas lift valve assemblies used in artificial gas lift systems. In particular, the gas lift valve assemblies described herein utilize a check valve having multiple sealing elements configured to sealingly engage a valve member at various pressure differentials. The check valve thereby provides a suitable barrier to leakage in an upstream direction across a wide range of pressures within a production tubing of gas lift systems. Additionally, the gas lift valve assemblies described herein facilitate improving the service life of gas lift valve assemblies, and decreasing the down time of gas lift systems by minimizing the wear of sealing components within the gas lift valve assemblies. In particular, the gas lift valve assemblies described herein utilize a check valve having a sealing mechanism disposed outside of the main fluid flow path of the gas lift valve assembly. The exposure of the sealing surfaces of the sealing components to high velocity fluid flow and solid, abrasive particles is thereby reduced as compared to gas lift valve assemblies having sealing components positioned directly within the main fluid flow path.

Figure 1:
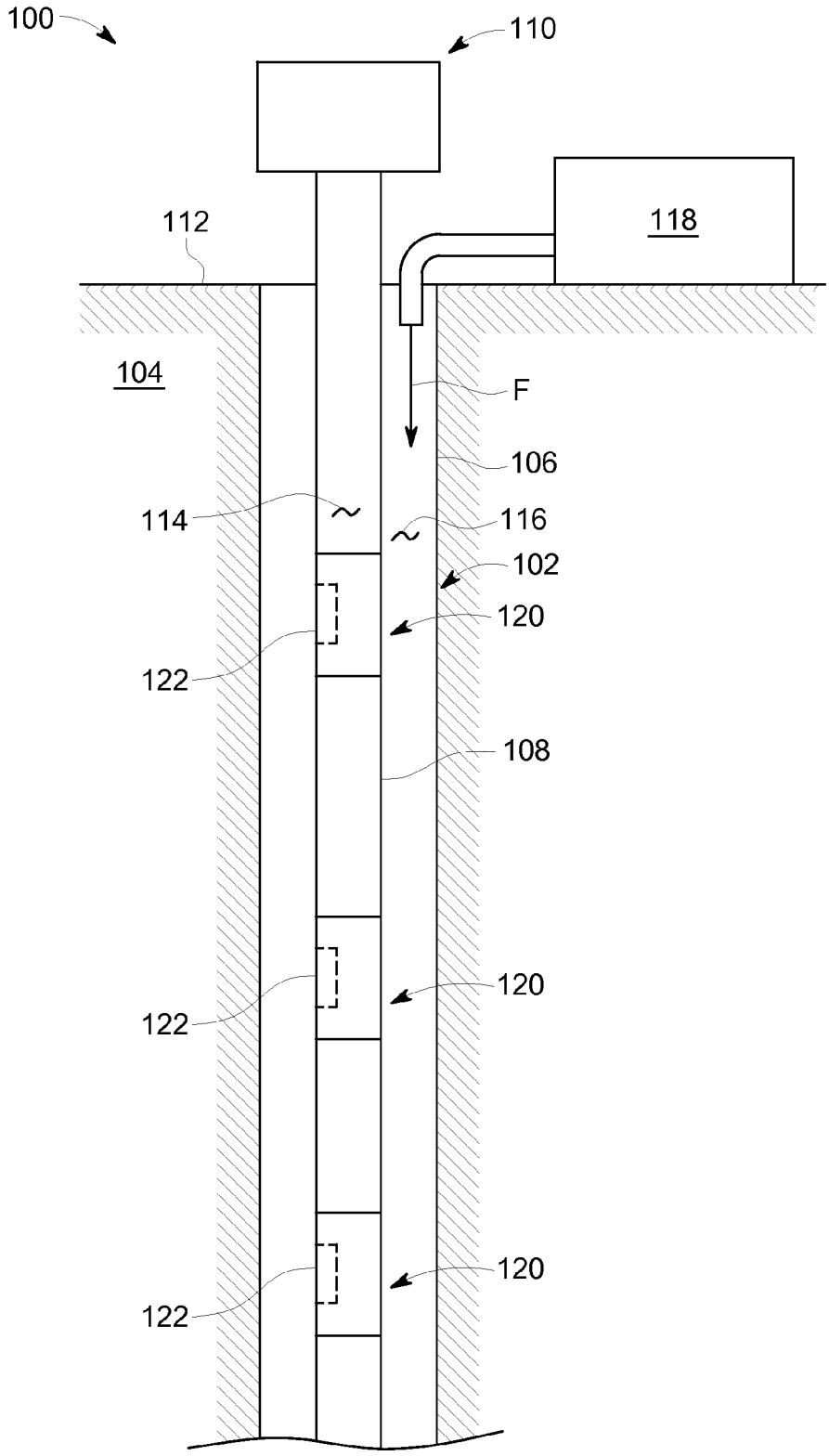
FIG. 1 is a schematic view of an exemplary gas lift system.

FIG. 1 is a schematic view of an exemplary gas lift system, indicated generally at 100, for removing fluids from a fluid-containing formation (not shown). In the exemplary embodiment, gas lift system 100 includes a wellbore 102 extending through the earth 104 to the fluid-containing formation. Wellbore 102 is lined with a well casing 106, and a production tubing 108 is disposed within well casing 106 and extends from a wellhead 110 at a surface 112 of earth 104 to the formation. Production tubing 108 defines a central passageway 114 through which fluid from the formation is communicated to wellhead 110. An outer annulus 116 is defined between production tubing 108 and well casing 106. A fluid injection device 118 is coupled in fluid communication with outer annulus 116 for injecting a pressurized fluid F, such as pressurized gas, into outer annulus 116 to create artificial lift within central passageway 114. Gas lift system 100 also includes a plurality of side pocket mandrels 120, each having a gas lift valve assembly 122 disposed therein for controlling fluid communication between outer annulus 116 and central passageway 114. Each mandrel 120 is coupled in series with production tubing 108 at each end of mandrel 120 by suitable connecting means including, for example and without limitation, a threaded connection.

Figure 2:
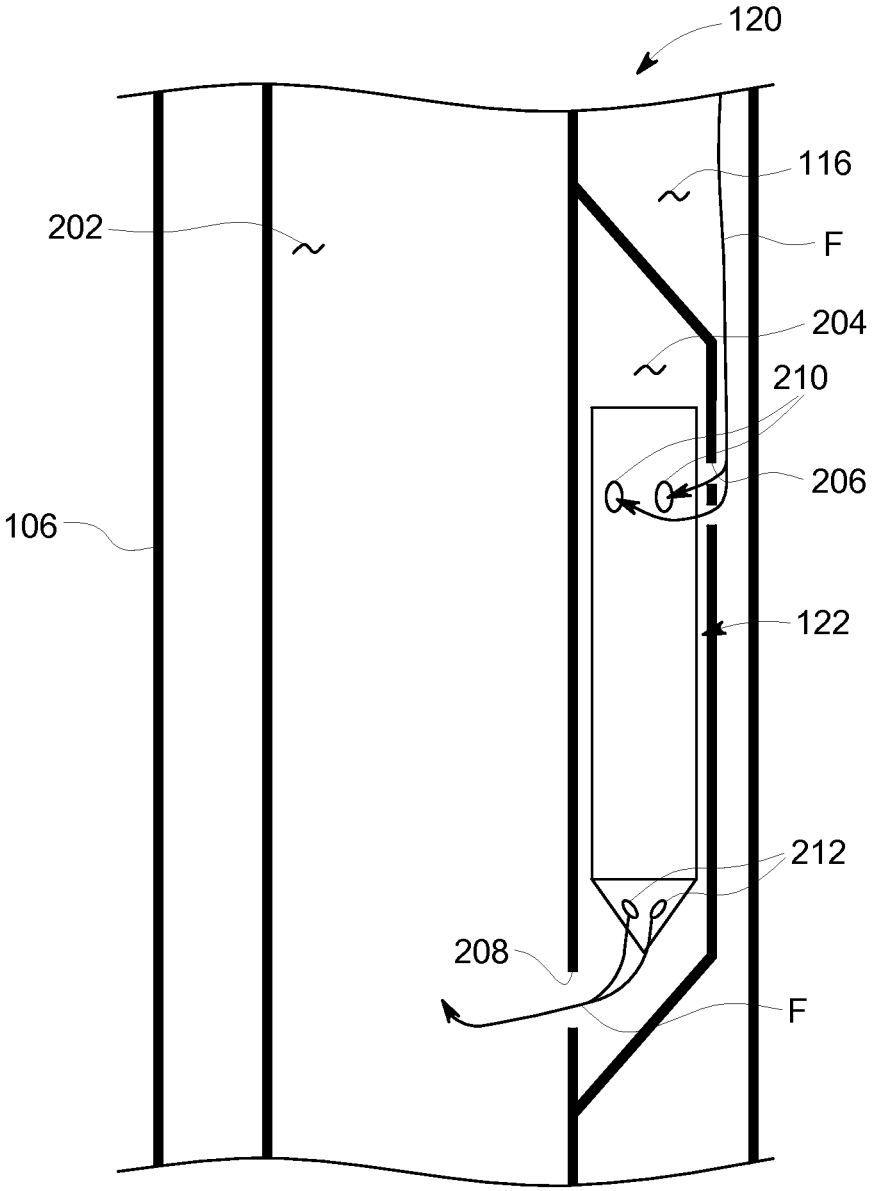
FIG. 2 is a schematic view of a mandrel of the gas lift system of FIG. 1 including a gas lift valve assembly.

FIG. 2 is a schematic view of one of mandrels 120 of FIG. 1, illustrating one of gas lift valve assemblies 122 disposed therein. As shown in FIG. 2, mandrel 120 defines a longitudinal passageway 202 and a side pocket 204 sized and shaped to receive one of gas lift valve assemblies 122 therein. Longitudinal passageway 202 is coupled in serial fluid communication with central passageway 114 of production tubing 108 (shown in FIG. 1). Mandrel 120 defines at least one mandrel inlet port 206 providing fluid communication between outer annulus 116 and side pocket 204, and at least one mandrel outlet port 208 providing fluid communication between side pocket 204 and longitudinal passageway 202.

Gas lift valve assembly 122 is configured to control fluid flow between outer annulus 116 and central passageway 114 (shown in FIG. 1) to ensure proper operation of gas lift system 100. More specifically, gas lift valve assembly 122 includes a plurality of inlet ports 210, a plurality of outlet ports 212, and one or more valve assemblies coupled in fluid communication between inlet ports 210 and outlet ports 212. At least one of the valve assemblies within gas lift valve assembly 122 is a one-way valve, also referred to as a check valve or barrier valve, configured to permit fluid flow in a downstream direction from outer annulus 116 to central passageway 114 (shown in FIG. 1) (i.e., from inlet ports 210 to outlet ports 212), and to inhibit fluid flow in an upstream direction from central passageway 114 (shown in FIG. 1) to outer annulus 116 (i.e., from outlet ports 212 to inlet ports 210). Mandrel 120 may include one or more sealing elements (not shown) disposed radially between gas lift valve assembly 122 and mandrel 120, and longitudinally between inlet ports 210 and outlet ports 212 to inhibit fluid flow along an exterior of gas lift valve assembly 122.

In operation, pressurized fluid F, such as gas, is injected into outer annulus 116 by fluid injection device 118. Pressurized fluid F is injected at a sufficient pressure such that pressurized fluid F is forced generally downward through outer annulus 116 to a depth at which one of mandrels 120 and one of gas lift valve assemblies 122 are located. Pressurized fluid F enters side pocket 204 of mandrel 120 through mandrel inlet ports 206, and enters gas lift valve assembly 122 through inlet ports 210. Pressurized fluid F is injected at a sufficient pressure to create a positive pressure differential between the upstream side of gas lift valve assembly 122 and the downstream side of gas lift valve assembly 122, thereby opening the one-way valve within gas lift valve assembly 122 and enabling fluid flow through gas lift valve assembly 122. Pressurized fluid F flows through gas lift valve assembly 122, out of outlet ports 212, and is injected into central passageway 114 (shown in FIG. 1) through mandrel outlet port 208. Pressurized fluid F displaces generally denser fluids from the fluid containing formation within central passageway 114, thereby reducing hydrostatic pressure within central passageway 114 and enabling or enhancing fluid flow from the fluid-containing formation to the wellhead 110 (shown in FIG. 1).

Figure 3:
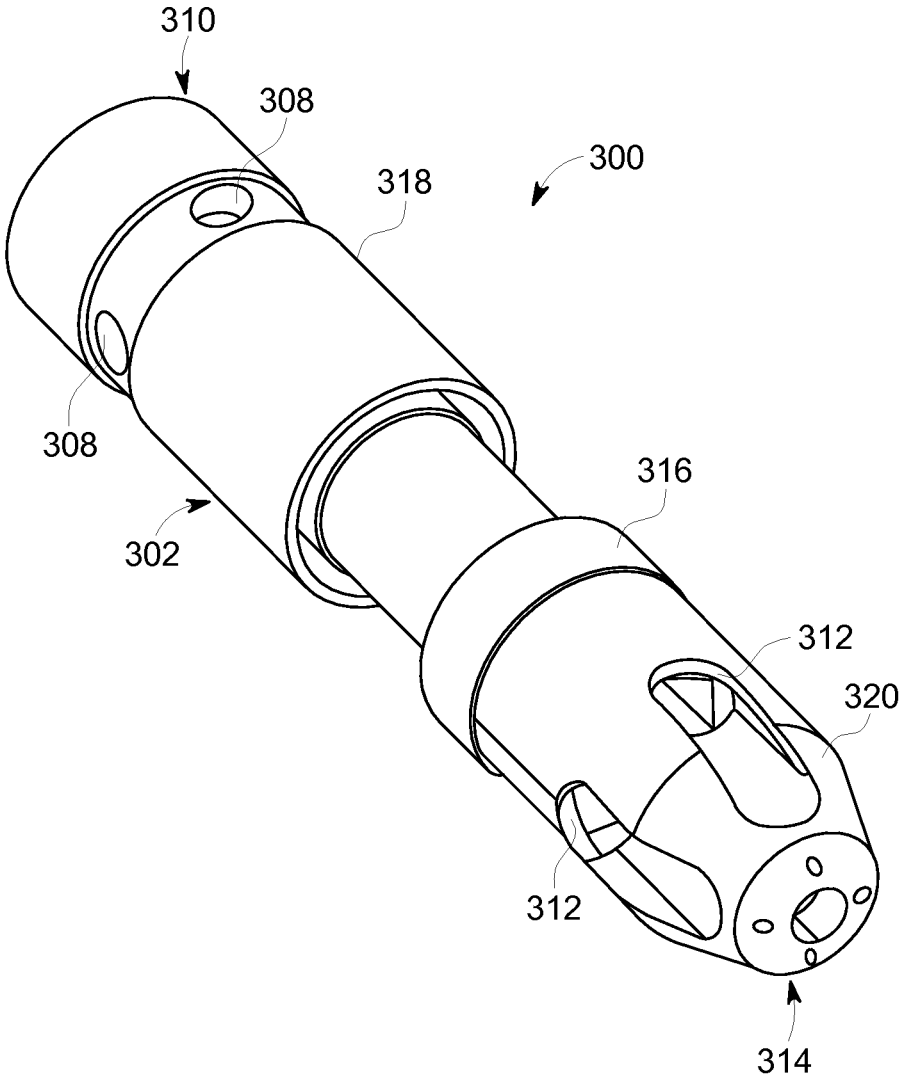
FIG. 3 is a perspective view of an exemplary gas lift valve assembly suitable for use in the gas lift system of FIG. 1.
Figure 4:
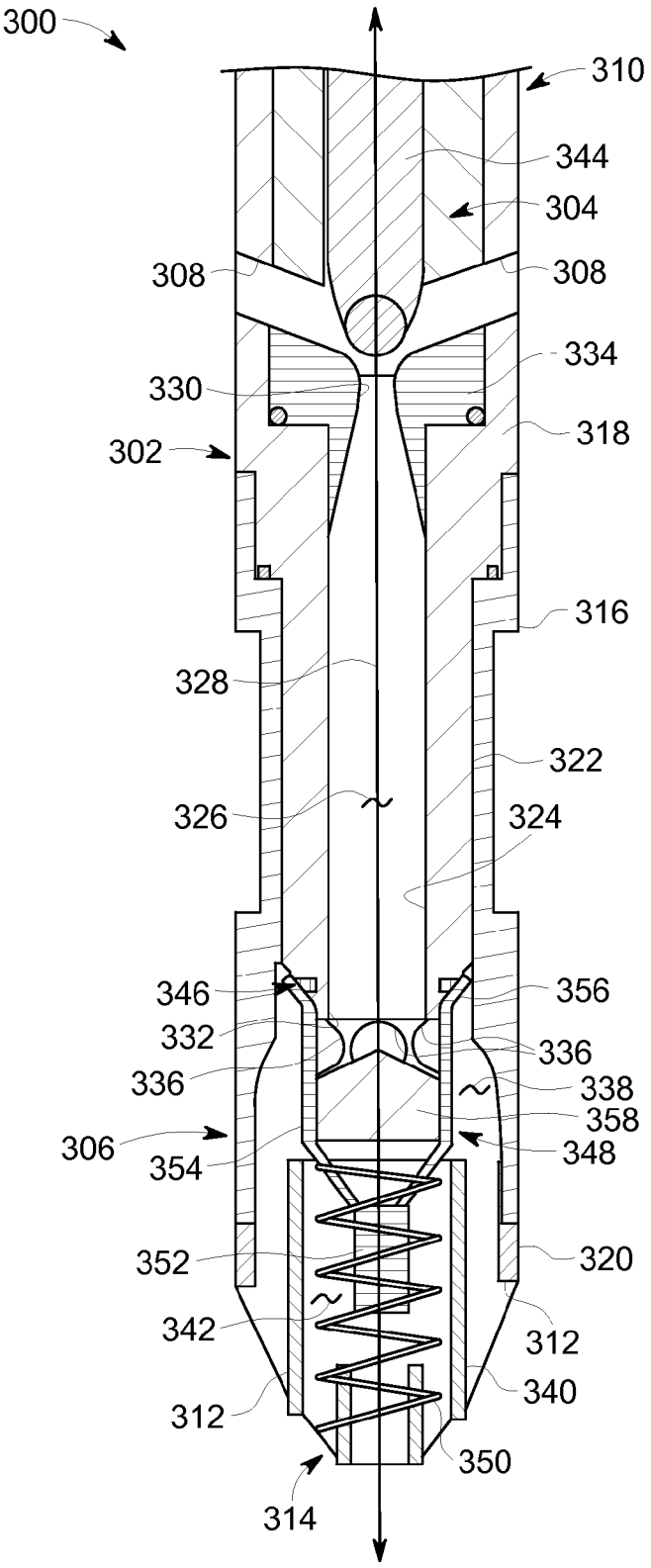
FIG. 4 is a cross-section of the gas lift valve assembly of FIG. 3 including an injection control valve and a check valve, the check valve shown in a closed position.
Figure 5:
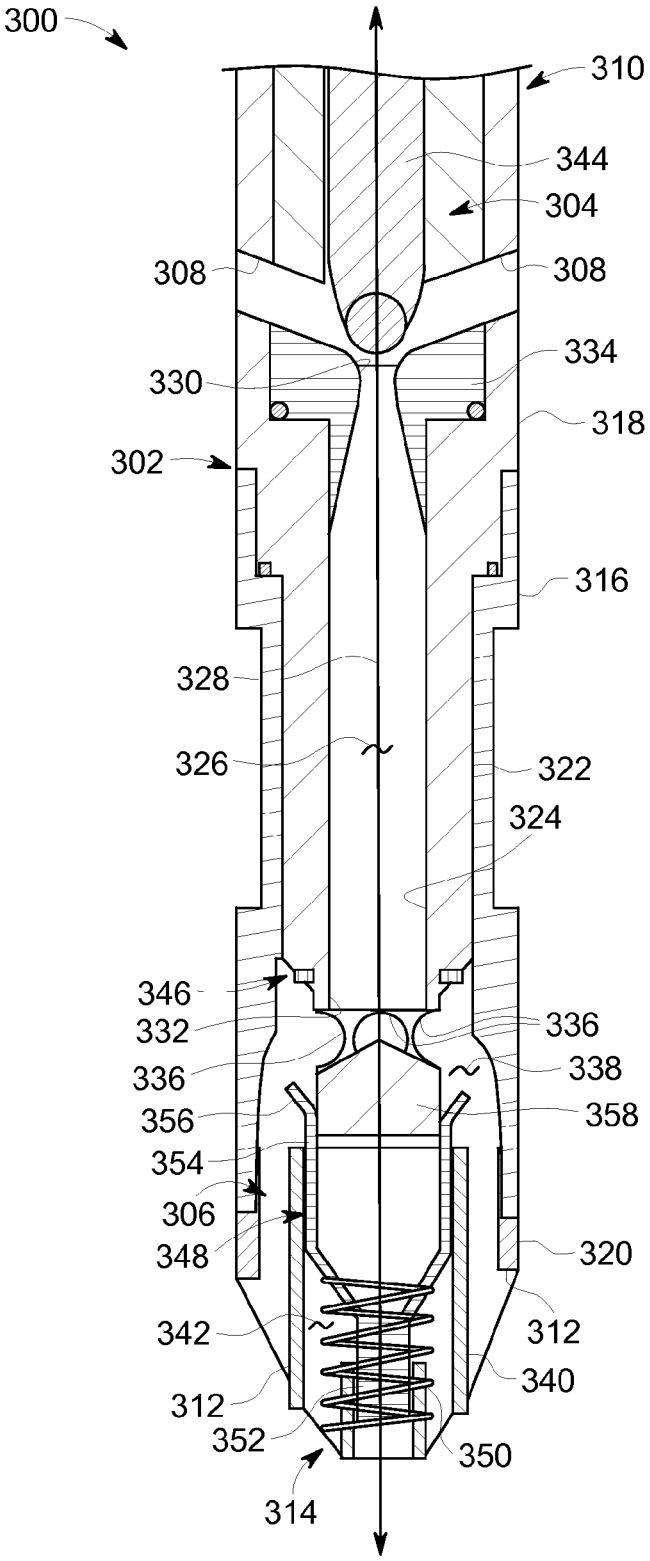
FIG. 5 is a cross-section of the gas lift valve assembly of FIG. 4 showing the check valve in an open position.

FIG. 3 is a perspective view of an exemplary gas lift valve assembly, indicated generally at 300, suitable for use in gas lift system 100 of FIGS. 1 and 2. FIGS. 4 and 5 are cross-sections of gas lift valve assembly 300 of FIG. 3. In the exemplary embodiment, gas lift valve assembly 300 includes a housing 302, an injection control valve 304 (broadly, a first valve), and a check valve 306 (broadly, a second valve). FIG. 4 shows check valve 306 in a closed position, and FIG. 5 shows check valve 306 in an open position.

Housing 302 defines a plurality of inlet ports 308 at an upstream end 310 of gas lift valve assembly 300, and a plurality of outlet ports 312 at a downstream end 314 of gas lift valve assembly 300. In the exemplary embodiment, housing 302 defines four inlet ports 308 and four outlet ports 312, although housing 302 may define any suitable number of inlet ports 308 and outlet ports 312 that enables gas lift valve assembly 300 to function as described herein. Gas lift valve assembly 300 is configured to receive pressurized fluid F from outer annulus 116 (shown in FIG. 1) through inlet ports 308, and expel pressurized fluid F through outlet ports 312.

In the exemplary embodiment, housing 302 includes an outer casing 316, an inner casing 318, and a lower housing portion 320. Inner casing 318 extends from upstream end 310 of gas lift valve assembly 300 towards downstream end 314 of gas lift valve assembly 300, and into a cavity defined by outer casing 316. Inner casing 318 is coupled to outer casing 316 by suitable connecting means including, for example and without limitation, a threaded connection. Lower housing portion 320 is coupled to outer casing 316 at downstream end 314 of gas lift valve assembly 300 by suitable connecting means including, for example and without limitation, a threaded connection. In the exemplary embodiment, outer casing 316, inner casing 318, and lower housing portion 320 are formed separately from one another, and are coupled to one another during assembly of gas lift valve assembly 300. In other embodiments, outer casing 316, inner casing 318, and/or lower housing portion 320 may be formed integrally with one another. In one embodiment, for example, outer casing 316 and inner casing 318 are formed inegrally with one another (i.e., outer casing 316 and inner casing 318 are formed from a unitary piece of material).

Housing 302, including outer casing 316, inner casing 318, and lower housing portion 320, may be constructed from a variety of suitable metals including, for example and without limitation, steel alloys (e.g., 316 stainless steel, 17-4 stainless steel), nickel alloys (e.g., 400 Monel®), and nickel-chromium based alloys (e.g., 718 Inconel®).

In the exemplary embodiment, inner casing 318 defines inlet ports 308, and lower housing portion 320 defines outlet ports 312. Inner casing 318 also includes a radial outer surface 322 and a radial inner surface 324 at least partially defining a main flow passage 326 extending in a longitudinal direction 328. Main flow passage 326 provides fluid communication between inlet ports 308 and outlet ports 312 when injection control valve 304 and check valve 306 are both in an open position (shown in FIG. 5). As shown in FIGS. 4 and 5, main flow passage 326 includes an upstream end 330 and a downstream end 332. In the exemplary embodiment, housing 302 also includes a venturi nozzle 334 disposed at upstream end 330 of main flow passage 326. Venturi nozzle 334 is configured to regulate the mass flow of pressurized fluid F injected into gas lift valve assembly 300.

In the exemplary embodiment, inner casing 318 also defines a plurality of flow guiding ports 336 at downstream end 332 of main flow passage 326. Flow guiding ports 336 are configured to direct fluid flow in a generally downstream direction, and away from sealing elements of check valve 306, described in more detail below. In particular, each flow guiding port 336 is defined in a plane oriented at an oblique angle with respect to longitudinal direction 328 of main flow passage 326 such that fluid flow through flow guiding ports 336 is in a generally downstream direction.

As shown in FIGS. 4 and 5, housing 302 also defines flow guiding channels 338 connected in fluid communication between main flow passage 326 and outlet ports 312. In the exemplary embodiment, flow guiding channels 338 are collectively defined by inner casing 318, outer casing 316, and lower housing portion 320. Flow guiding channels 338 are configured to direct fluid flow away from sealing elements of check valve 306. Specifically, each flow guiding channel 338 extends downstream and radially outward from a corresponding fluid guiding port 336 to direct fluid flow away from sealing elements of check valve 306, described in more detail herein.

In the exemplary embodiment, lower housing portion 320 extends from outer casing 316 to downstream end 314 of gas lift valve assembly 300, and defines outlet ports 312 at downstream end 314 of gas lift valve assembly 300. Further, in the exemplary embodiment, lower housing portion 320 includes an annular sidewall 340 positioned radially inward from outlet ports 312. Sidewall 340 extends in longitudinal direction 328, and defines a longitudinally extending recess 342 also positioned radially inward from outlet ports 312. As described in more detail herein, recess 342 is configured to receive components of check valve 306 therein to reduce vortex shedding at downstream end 314 of gas lift valve assembly 300.

Injection control valve 304 is coupled in fluid communication between inlet ports 308 and main flow passage 326, and is configured to regulate fluid flow between inlet ports 308 and main flow passage 326. In the exemplary embodiment, injection control valve 304 includes a valve member 344 moveable between an open position (shown in FIGS. 4 and 5) in which injection control valve 304 permits fluid flow between inlet ports 308 and main flow passage 326, and a closed position (not shown) in which injection control valve 304 inhibits fluid flow between inlet ports 308 and main flow passage 326. When valve member 344 is in the closed position, valve member 344 sealingly engages a valve seat defined by housing 302. In the exemplary embodiment, the valve seat of injection control valve 304 is defined by venturi nozzle 334.

Injection control valve 304 also includes a suitable biasing member (not shown) operably coupled to valve member 344 and configured to bias valve member 344 towards the closed position. In one embodiment, for example, valve member 344 is coupled to a bellows system that exerts a biasing force on valve member 344 to maintain valve member 344 in the closed position. The biasing force exerted on valve member 344 may correspond to a predetermined threshold pressure of pressurized fluid F needed to activate the biasing member and open valve member 344.

Check valve 306 is disposed at downstream end 332 of main flow passage 326 and is configured to permit fluid flow in the downstream direction (i.e., from inlet ports 308 to outlet ports 312) and inhibit fluid flow in the upstream direction (i.e., from outlet ports 312 to inlet ports 308). In the exemplary embodiment, check valve 306 includes a sealing mechanism 346, a valve member 348, and a biasing member 350 operably coupled to valve member 348. Valve member 348 is moveable between a closed position (shown in FIG. 4) in which valve member 348 sealingly engages sealing mechanism 346, and an open position (shown in FIG. 5) in which valve member 348 permits fluid flow in the downstream direction. Biasing member 350 exerts a biasing force against valve member 348, and biases valve member 348 towards the closed position (shown in FIG. 4). Valve member 348 is configured to move between the open position and the closed position based on a pressure differential across check valve 306. Specifically, when the pressure differential from the upstream side of check valve 306 to the downstream side of check valve 306 is sufficient to overcome the biasing force of biasing member 350, valve member 348 moves to the open position. When the pressure differential from the upstream side of check valve 306 to the downstream side of check valve 306 falls below the threshold pressure needed to overcome the biasing force of biasing member 350 (e.g., when the pressure in central passageway 114 of production tubing 108 (shown in FIG. 1) is greater than the pressure in outer annulus 116 (shown in FIG. 1)), valve member 348 moves to the closed position (shown in FIG. 4).

As shown in FIGS. 4 and 5, radial outer surface 322 of inner casing 318 defines a valve seat of check valve 306. Specifically, valve member 348 is configured to engage radial outer surface 322 of inner casing 318 when valve member 348 is in the closed position. Sealing mechanism 346 is disposed around radial outer surface 322 of inner casing 318, and is thus positioned out of main flow passage 326. The exposure of the valve seat and sealing mechanism 346 of check valve 306 to high velocity fluid flow and solid, abrasive particles is thereby reduced as compared to gas lift valves having a valve seat positioned within the main flow passage.

In the exemplary embodiment, valve member 348 includes a valve stem 352, a cup-shaped portion 354 extending from valve stem 352, and an outwardly extending sealing segment 356 configured to sealingly engage sealing mechanism 346. Sealing segment 356 is shaped complementary to the portion of radial outer surface 322 that defines the valve seat of check valve 306. In the exemplary embodiment, sealing segment 356 is conically shaped, and extends outward from cup-shaped portion 354 at an oblique angle. Sealing segment 356 may extend outward from cup-shaped portion 354 at any suitable angle that enables gas lift valve assembly 300 to function as described herein. In the exemplary embodiment, sealing segment 356 extends outward form cup-shaped portion 354 at an angle in the range of between about 120° and about 180°, and more specifically, at an angle of about 150°. In other embodiments, sealing segment 356 may extend outward from cup-shaped portion 354 at an angle less than 120°, such as an angle of about 90°. Valve member 348 may be constructed from a variety of suitable materials including, for example and without limitation, steel alloys (e.g., 316 stainless steel, 17-4 stainless steel), nickel alloys (e.g., 400 Monel®), and nickel-chromium based alloys (e.g., 718 Inconel®).

In the exemplary embodiment, inner casing 318 includes a valve guide member 358 configured to engage cup-shaped portion 354 of valve member 348 to facilitate maintaining alignment of valve member 348 within gas lift valve assembly 300. More specifically, valve guide member 358 has a cross-section sized and shaped to be received within an interior defined by valve member 348 and to engage an interior surface of valve member 348.

Valve stem 352 is operably coupled to biasing member 350, which is fixed to lower housing portion 320. In the exemplary embodiment, biasing member 350 is a compression spring, although biasing member 350 may include any suitable biasing element that enables gas lift valve assembly 300 to function as described herein. In some embodiments, biasing member 350 may be omitted from check valve 306, and valve member 344 may be actuated based solely on a pressure differential across valve member 344.

In the exemplary embodiment, biasing member 350 is disposed within recess 342 defined by lower housing portion 320. As shown in FIGS. 4 and 5, recess 342 is sized and shaped to receive valve member 348 when valve member 348 is in the open position, and valve member 348 is configured to slide in a longitudinal direction within recess 342 as valve member 348 moves between the open and closed positions. A substantial portion of valve member 348 is thus positioned out of the main flow path when valve member 348 is open and fluid is flowing through gas lift valve assembly 300, thereby limiting the amount of vortex shedding at downstream end 314 of gas lift valve assembly 300.

Sealing mechanism 346 may include one or more sealing elements configured to sealingly engage sealing segment 356 of valve member 348 when valve member 348 is in the closed position (shown in FIG. 4). In some embodiments, sealing mechanism 346 includes a low pressure sealing element configured to sealing engage valve member 348 at relatively low pressures, and a high pressure sealing element configured to sealing engage valve member 348 at relatively high pressures.

Figure 6:
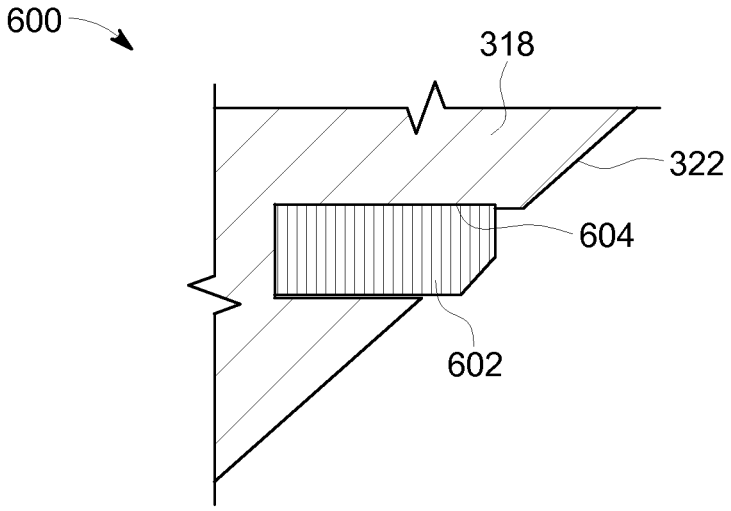
FIG. 6 is a partial cross-section of an exemplary sealing mechanism suitable for use in the gas lift valve assembly of FIG. 4.

FIG. 6 is a partial cross-section of an exemplary embodiment of a sealing mechanism 600 suitable for use with gas lift valve assembly 300. As shown in FIG. 6, sealing mechanism 600 includes a low pressure sealing element 602 disposed within an annular groove 604 defined by inner casing 318. Groove 604 extends radially inward from radial outer surface 322 of inner casing 318, and is sized and shaped to receive low pressure sealing element 602. Low pressure sealing element 602 is generally ring-shaped, and may be constructed from a variety of suitable materials including, for example and without limitation, elastomers and thermoplastics, such as polytetrafluoroethylene (PTFE).

In the embodiment illustrated in FIG. 6, sealing mechanism 600 also includes a high pressure sealing element defined by radial outer surface 322 of inner casing 318. That is, the high pressure sealing element includes a portion of radial outer surface 322 of inner casing 318. Valve member 348 (shown in FIGS. 4 and 5) is configured to sealingly engage low pressure sealing element 602 at a first pressure differential across valve member 348, and is configured to sealingly engage the high pressure sealing element at a second pressure differential across valve member 348 that is greater than the first pressure differential. Specifically, as the pressure differential across valve member 348 increases, the back pressure acting on valve member 348 compresses low pressure sealing element 602, and forces valve member 348 into sealing engagement with radial outer surface 322 of inner casing 318. As the pressure differential continues to increase, the high pressure sealing element (i.e., radial outer surface 322 of inner casing 318) absorbs a greater portion of the contact stresses between valve member 348 and sealing mechanism 600 than low pressure sealing element 602 does. Thus, even at relatively high pressures, low pressure sealing element 602 is subjected to only slightly higher contact stresses, thereby reducing the amount of wear on low pressure sealing element 602 at high pressures, and increasing the service life of low pressure sealing element 602. In other embodiments, sealing mechanism 600 may include a high pressure sealing element formed separately from inner casing 318. In one embodiment, for example, sealing mechanism 600 includes a ring-shaped high pressure sealing element disposed within an annular groove defined by inner casing 318 (see, e.g., FIG. 7). The high pressure sealing element of sealing mechanism 600 is suitably stiffer than and has a greater modulus of elasticity than the low pressure sealing element 602, and is suitably constructed from one or more metal alloys. Suitable metals from which the high pressure sealing element may be constructed include, for example and without limitation, the same materials from which housing 302 is constructed.

The pressure differential across valve member 348 at which valve member 348 sealingly engages the high pressure sealing element varies depending upon the construction of low pressure sealing element 602 and the high pressure sealing element. In some embodiments, for example, the pressure differential across valve member 348 at which valve member 348 sealingly engages the high pressure sealing element is in the range of about 1,500 pounds per square inch and about 2,500 pounds per square inch, and more suitably, is in the range of about 1,800 pounds per square inch and about 2,200 pounds per square inch.

Figure 7:
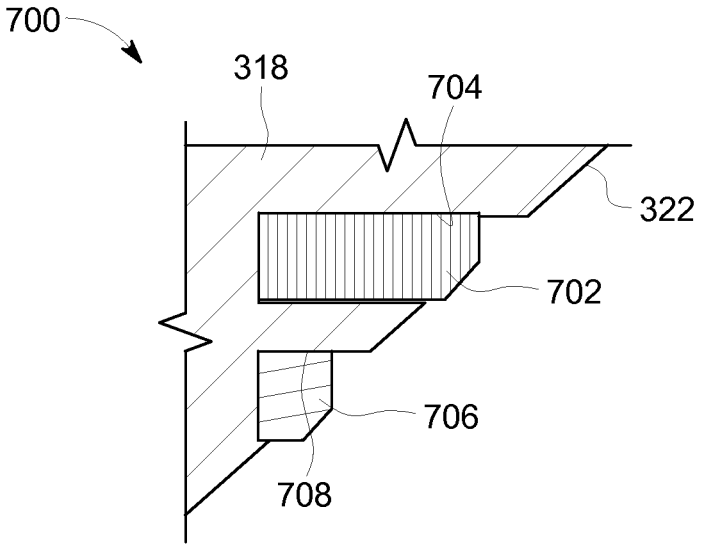
FIG. 7 is a partial cross-section of another exemplary sealing mechanism suitable for use in the gas lift valve assembly of FIG. 4.

FIG. 7 is a partial cross-section of another exemplary sealing mechanism 700 suitable for use with gas lift valve assembly 300. In the embodiment illustrated in FIG. 7, sealing mechanism 700 includes a first sealing element 702 disposed in a first annular groove 704 defined by inner casing 318, and a second sealing element 706 disposed in a second annular groove 708 defined by inner casing 318. Each of first annular groove 704 and second annular groove 708 extend radially inward from radial outer surface 322 of inner casing 318. First sealing element 702 and second sealing element 706 each have a generally ring-shaped configuration. First sealing element 702 and second sealing element 706 are constructed from different materials, and are generally configured to sealingly engage valve member 348 at different pressure differentials. For example, first sealing element 702 is configured to sealingly engage valve member 348 at a first pressure differential, and second sealing element 706 is configured to sealingly engage valve member 348 at a second pressure differential that is greater than the first pressure differential. Thus, as the pressure differential across valve member 348 increases above the second pressure differential, second sealing element 706 absorbs a greater portion of the contact stresses between valve member 348 and sealing mechanism 700 than first sealing element 702 does. As a result, first sealing element 702 is subjected to only slightly higher contact stresses as the pressure differential across valve member 348 increases above the second pressure differential, thereby reducing the amount of wear on first sealing element 702 and increasing the service life of first sealing element 702. In other suitable embodiments, sealing mechanism 700 may include any suitable number of sealing elements that enables sealing mechanism 700 to function as described herein.

In operation, pressurized fluid F is injected into outer annulus 116 (shown in FIG. 1) from fluid injection device 118 at a sufficient pressure to activate the biasing member of injection control valve 304, and thereby move valve member 344 of injection control valve 304 from the closed position (shown in FIG. 4) to the open position (shown in FIG. 5). Pressurized fluid F flows into gas lift valve assembly 300 through inlet ports 308, and into main flow passage 326 through venturi nozzle 334. The initial pressure differential across check valve 306 created by pressurized fluid F is sufficient to move the valve member 348 from the closed position (shown in FIG. 4) to the open position (shown in FIG. 5), and thereby enable fluid flow through gas lift valve assembly 300. As pressurized fluid F flows through main flow passage 326, flow guiding ports 336 and flow guiding channels 338 direct pressurized fluid F away from sealing mechanism 346, thereby reducing or eliminating the erosive effects of fluid flow on sealing mechanism 346. Pressurized fluid F exits gas lift valve assembly 300 at outlet ports 312, and enters central passageway 114 of production tubing 108 (both shown in FIG. 1) through mandrel outlet ports 208 (shown in FIG. 2).

Figure 8:
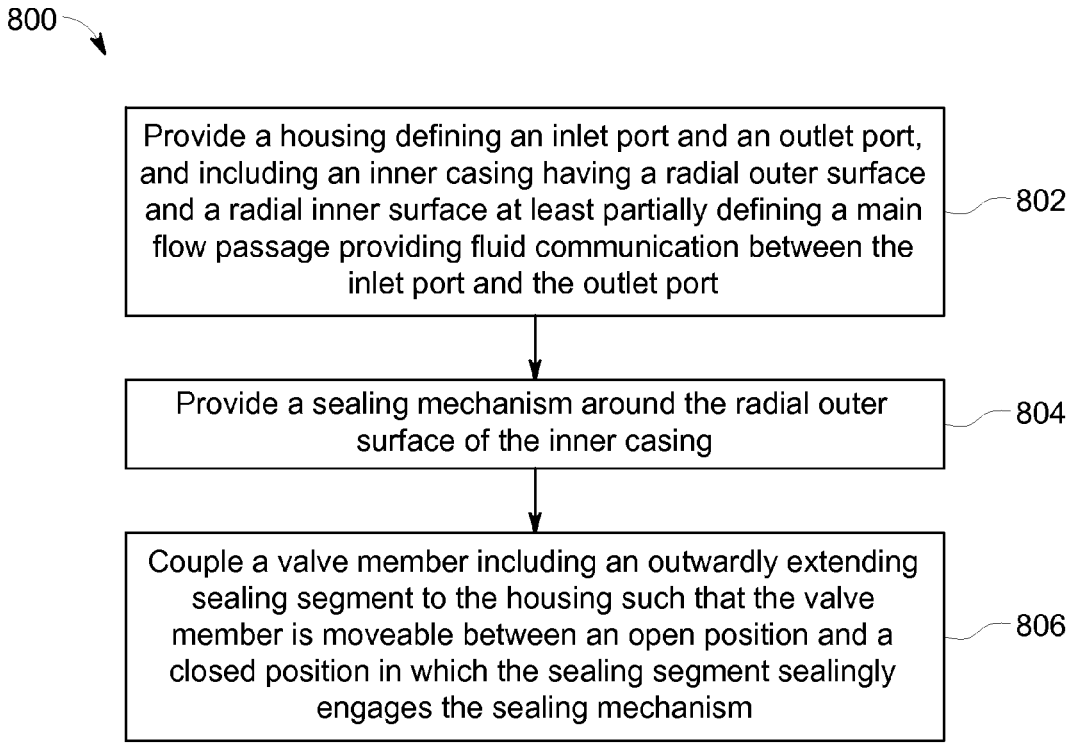
FIG. 8 is a flow chart of an exemplary method for assembling a gas lift valve assembly.

FIG. 8 is a flow chart of an exemplary method 800 of assembling a gas lift valve assembly, such as gas lift valve assembly 300 shown in FIGS. 3-5. Referring to FIGS. 3-7, in the exemplary method, a housing, such as housing 302, is provided 802 that defines an inlet port and an outlet port, and includes an inner casing, such as inner casing 318, having a radial outer surface and a radial inner surface at least partially defining a main flow passage providing fluid communication between the inlet port and the outlet port. A sealing mechanism, such as sealing mechanism 600 (shown in FIG. 6) or sealing mechanism 700 (shown in FIG. 7), is provided 804 around the radial outer surface of the inner casing. A valve member, such as valve member 348, including an outwardly extending sealing segment is coupled 806 to the housing such that the valve member is moveable between an open position and a closed position in which the sealing segment sealingly engages the sealing mechanism. In some embodiments, providing a sealing mechanism includes providing a low pressure sealing element configured to sealingly engage the valve member at a first pressure differential across the valve member, and providing a high pressure sealing element configured to sealingly engage the valve member at a second pressure differential across the valve member greater than the first pressure differential. In some embodiments, method 800 may also include coupling an injection control valve, such as injection control valve 304, in fluid communication between the inlet port and the main flow passage to regulate fluid flow between the inlet port and the main flow passage. In some embodiments, the housing may include a lower housing portion, such as lower housing portion 320, defining a longitudinally extending recess positioned radially inward from the outlet port, and coupling the valve member may include coupling the valve member to the housing such that the valve member is received within the recess when the valve member is in the open position.

The systems, methods, and apparatus described herein facilitate reducing the leakage rate and improving the service life of gas lift valve assemblies used in gas lift systems. In particular, the gas lift valve assemblies described herein utilize a check valve having multiple sealing elements configured to sealingly engage a valve member at various pressure differentials. The check valve thereby provides a suitable barrier to leakage in an upstream direction across a wide range of pressures within a production tubing of gas lift systems. Additionally, the gas lift valve assemblies described herein facilitate improving the service life of gas lift valve assemblies, and decreasing the down time of gas lift systems by minimizing the wear of sealing components with the gas lift valve assemblies. In particular, the gas lift valve assemblies described herein utilize a check valve having a sealing mechanism disposed outside of the main fluid flow path of the gas lift valve assembly. The exposure of the sealing surfaces of the sealing components to high velocity fluid flow and solid, abrasive particles is thereby reduced as compared to gas lift valve assemblies having sealing components positioned directly within the main flow passage.

An exemplary technical effect of the systems, methods, and apparatus described herein includes at least one of: (a) facilitating reducing the leakage rate of gas lift valve assemblies used in artificial gas lift systems; (b) improving the service life and reliability of gas lift valve assemblies used in artificial gas lift valve assemblies; and (c) decreasing the wear rate of sealing components used in gas lift valve assemblies of artificial gas lift systems.

Exemplary embodiments of gas lift systems and gas lift valve assemblies are described above in detail. The apparatus, systems, and methods are not limited to the specific embodiments described herein, but rather, operations of the methods and components of the systems may be utilized independently and separately from other operations or components described herein. For example, the systems, methods, and apparatus described herein may have other industrial or consumer applications and are not limited to practice with the specific embodiments described herein. Rather, one or more embodiments may be implemented and utilized in connection with other industries.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A gas lift valve assembly comprising:

a housing defining an inlet port and an outlet port, said housing comprising:

an outer casing; and an inner casing having a radial outer surface and a radial inner surface at least partially defining a main flow passage providing fluid communication between the inlet port and the outlet port; and a check valve comprising:

a sealing mechanism disposed around said radial outer surface of the inner casing; and a valve member comprising an outwardly extending sealing segment, said valve member moveable between an open position, in which said sealing segment is spaced from said sealing mechanism and said outer casing such that fluid flow is facilitated between said sealing segment and said outer casing, and a closed position in which said sealing segment sealingly engages said sealing mechanism, wherein said valve member further comprises a valve stem and a hollow cup-shaped portion extending from said valve stem, said sealing segment extending outward from said cup-shaped portion.

2. The gas lift valve assembly in accordance with claim 1, wherein said sealing mechanism comprises a high pressure sealing element and a low pressure sealing element, said valve member configured to sealingly engage said low pressure sealing element at a first pressure differential across said valve member, and to sealingly engage said high pressure sealing element at a second pressure differential across said valve member greater than the first pressure differential.

3. The gas lift valve assembly in accordance with claim 2, wherein said high pressure sealing element comprises a portion of said radial outer surface.

4. The gas lift valve assembly in accordance with claim 2, wherein said inner casing defines a groove extending radially inward from said radial outer surface, said low pressure sealing element disposed within the groove.

5. The gas lift valve assembly in accordance with claim 1, further comprising an injection control valve coupled in serial fluid communication with and upstream from said check valve, said injection control valve configured to regulate fluid flow between the inlet port and the main flow passage.

6. The gas lift valve assembly in accordance with claim 5, wherein the main flow passage has an upstream end and a downstream end, said housing further comprising a venturi nozzle disposed at the upstream end of the main flow passage, said venturi nozzle defining a valve seat of said injection control valve.

7. The gas lift valve assembly in accordance with claim 1, wherein said inner casing defines a plurality of flow guiding ports at a downstream end of the main flow passage, each of the flow guiding ports configured to direct fluid flow from the main flow passage away from said sealing mechanism.

8. The gas lift valve assembly in accordance with claim 1, wherein said housing further comprises a lower housing portion defining a longitudinally extending recess positioned radially inward from the outlet port, the recess configured to receive said valve member therein when said valve member is in the open position.

9. The gas lift valve assembly in accordance with claim 8, wherein said check valve further comprises a biasing member configured to bias said valve member towards the closed position, said biasing member disposed within the recess.

10. The gas lift valve assembly in accordance with claim 1, wherein said inner casing comprises a valve guide member configured to engage said cup-shaped portion to facilitate maintaining alignment of said valve member.

11. A method of assembling a gas lift valve assembly, said method comprising:

providing a housing defining an inlet port and an outlet port, the housing including an outer casing and an inner casing, the inner casing having a radial outer surface and a radial inner surface at least partially defining a main flow passage providing fluid communication between the inlet port and the outlet port;

providing a sealing mechanism around the radial outer surface of the inner casing; and coupling a valve member including an outwardly extending sealing segment to the housing such that the valve member is moveable between an open position, in which the sealing segment is spaced from the sealing mechanism and the outer casing such that fluid flow is facilitated between the sealing segment and the outer casing, and a closed position in which the sealing segment sealingly engages the sealing mechanism, wherein said valve member further comprises a valve stem and a hollow cup-shaped portion extending from said valve stem, said sealing segment extending outward from said cup-shaped portion.

12. The method in accordance with claim 11, wherein providing a sealing mechanism comprises providing a low pressure sealing element and a high pressure sealing element, the low pressure sealing element configured to sealingly engage the valve member at a first pressure differential across the valve member, and the high pressure sealing element configured to sealingly engage the valve member at a second pressure differential across the valve member greater than the first pressure differential.

13. The method in accordance with claim 11, further comprising coupling an injection control valve in fluid communication between the inlet port and the main flow passage to regulate fluid flow between the inlet port and the main flow passage.

14. The method in accordance with claim 11, wherein the housing further includes a lower housing portion defining a longitudinally extending recess positioned radially inward from the outlet port, wherein coupling the valve member further comprises coupling the valve member to the housing such that the valve member is received within the recess when the valve member is in the open position.

15. A gas lift system comprising:

a production tubing defining a central passageway;

a well casing defining an annulus between said production tubing and said well casing; and a gas lift valve assembly coupled in fluid communication between the annulus and the central passageway, said gas lift valve assembly comprising:

a housing defining an inlet port and an outlet port, said housing comprising:

an outer casing; and an inner casing having a radial outer surface and a radial inner surface at least partially defining a main flow passage providing fluid communication between the inlet port and the outlet port; and a check valve comprising:

a sealing mechanism disposed around the radial outer surface of the inner casing; and a valve member comprising an outwardly extending sealing segment, said valve member moveable between an open position, in which said sealing segment is spaced from said sealing mechanism and said outer casing such that fluid flow is facilitated between said sealing segment and said outer casing, and a closed position in which said sealing segment sealingly engages said sealing mechanism, wherein said valve member further comprises a valve stem and a hollow cup-shaped portion extending from said valve stem, said sealing segment extending outward from said cup-shaped portion.

16. The gas lift system in accordance with claim 15, wherein said sealing mechanism comprises a high pressure sealing element and a low pressure sealing element, said valve member configured to sealingly engage said low pressure sealing element at a first pressure differential across said valve member, and to sealingly engage said high pressure sealing element at a second pressure differential across said valve member greater than the first pressure differential.

17. The gas lift system in accordance with claim 16, wherein said inner casing defines a groove extending radially inward from said radial outer surface, said low pressure sealing element disposed within the groove.

18. The gas lift system in accordance with claim 15, wherein said gas lift assembly further comprises an injection control valve coupled in serial fluid communication with and upstream from said check valve, said injection control valve configured to regulate fluid flow between the inlet port and the main flow passage.

19. The gas lift system in accordance with claim 15, wherein said inner casing defines a plurality of flow guiding ports at a downstream end of the main flow passage, each of the flow guiding ports configured to direct fluid flow from the main flow passage away from said sealing mechanism.

* * * * *